US011687034B2

(12) United States Patent
Denden

(10) Patent No.: US 11,687,034 B2
(45) Date of Patent: Jun. 27, 2023

(54) DISPLAY CHANGE MECHANISM

(71) Applicant: Blancpain SA, Le Brassus (CH)

(72) Inventor: Mehdi Denden, Les Rousses (FR)

(73) Assignee: BLANCPAIN S.A., Le Brassus (CH)

( * ) Notice: Subject to any disclaimer, the term of this patent is extended or adjusted under 35 U.S.C. 154(b) by 281 days.

(21) Appl. No.: 16/952,319

(22) Filed: Nov. 19, 2020

(65) Prior Publication Data

US 2021/0191325 A1 Jun. 24, 2021

(30) Foreign Application Priority Data

Dec. 20, 2019 (EP) ..... 19218749

(51) Int. Cl.

| | |
|---|---|
| ***G04B 13/02*** | (2006.01) |
| ***G04B 15/14*** | (2006.01) |
| ***G04B 19/04*** | (2006.01) |

(52) U.S. Cl.

CPC ..... *G04B 13/028* (2013.01); *G04B 15/14* (2013.01); *G04B 19/042* (2013.01)

(58) Field of Classification Search

CPC ..... G04B 13/028; G04B 15/14; G04B 19/042
See application file for complete search history.

(56) References Cited

U.S. PATENT DOCUMENTS

| | | | | |
|---|---|---|---|---|
| 9,158,284 | B1 * | 10/2015 | Crettex | G04B 19/02 |
| 2004/0264303 | A1 | 12/2004 | Brida et al. | |
| 2006/0028918 | A1 | 2/2006 | Groothuis et al. | |
| 2008/0304370 | A1 | 12/2008 | Scheufele | |
| 2011/0205852 | A1 * | 8/2011 | Zaugg | G04B 19/223 368/21 |
| 2011/0299365 | A1 * | 12/2011 | De Biase | G04B 19/241 368/70 |
| 2013/0182543 | A1 | 7/2013 | Crettex | |

FOREIGN PATENT DOCUMENTS

| | | | |
|---|---|---|---|
| CH | 703 837 | A1 | 3/2012 |
| CH | 709 717 | A2 | 11/2015 |
| CN | 102169322 | A | 8/2011 |
| CN | 102279558 | A | 12/2011 |
| CN | 103180786 | A | 6/2013 |
| CN | 107045277 | A | 8/2017 |
| EP | 1 491 972 | A1 | 12/2004 |
| EP | 2 362 277 | A1 | 8/2011 |
| HK | 1085895 | A1 | 9/2006 |
| JP | 2005-017292 | A | 1/2005 |
| JP | 2011-174932 | A | 9/2011 |
| JP | 2011-257398 | A | 12/2011 |
| KR | 10-2011-0097656 | A | 8/2011 |

OTHER PUBLICATIONS

European Search Report of EP 19 21 8749.0 dated Jun. 18, 2020.

* cited by examiner

*Primary Examiner* — Edwin A. Leon
*Assistant Examiner* — Kevin Andrew Johnston
(74) *Attorney, Agent, or Firm* — Sughrue Mion, PLLC

(57) ABSTRACT

A display mechanism (100) allowing display change with a single display mobile (150) so as to indicate a first piece of information with a first counter (110) and second piece of information with a second counter (120). This change is performed by the permutation of a clutch organ (130) displacing between a first position (131) and a second position (132) when the clutch organ (130) is controlled by a control organ (140).

16 Claims, 4 Drawing Sheets

DISPLAY CHANGE MECHANISM

CROSS REFERENCE TO RELATED APPLICATIONS

This application is claiming priority based on European Patent Application No. 19218749.0 filed on Dec. 20, 2019, the disclosure of which is incorporated herein in its entirely by reference.

TECHNICAL FIELD

The field of the present invention relates to that of watchmaking, and more specifically that of display mechanisms allowing to display two different pieces of information on the same dial and/or with the same indicator and preferably with the same hand.

TECHNOLOGICAL BACKGROUND

Mechanical watches, and in particular complicated watches, are constructed so as to be able to display several indications such as the date, the month, the week, the power reserve, the time difference, etc., thus overloading the dial at the risk of losing readability.

Indeed, it is often complicated to read an indication as the dial is overloaded, not to mention the visual surface taken up by the hands and by the thickness of the hand-fitting, which leads to a thicker watch. Moreover, adding an additional hand involves additional elements and leads to a "pyramid" construction, as it is called in the art.

SUMMARY OF THE INVENTION

The present invention proposes to totally or partially resolve these disadvantages, and in particular to display several pieces of information on a single hand and the choice of the display is made at the request of the user by means of a push-button, for example, by means of a display mechanism comprising at least:

- a first counter: said at least one first counter being configured to be movable and to indicate a first piece of information;
- a second counter: said at least one second counter being configured to be movable and to indicate a second piece of information;
- a display mobile: said at least one display mobile being configured to display said first piece of information of said at least one first counter and/or to display said second piece of information of said at least one second counter;
- a clutch organ: said at least one clutch organ being configured to displace said at least one display mobile between at least one first position so as to display said first piece of information and at least one second position so as to display said second piece of information; and,
- a control organ: said at least one control organ being configured to displace said at least one clutch organ between said at least one first position and said at least one second position.

Thanks to this arrangement, it is possible to display and in particular to indicate two pieces of information via a single display mobile. Indeed, thanks to the present invention, it is possible to arrange several indications while keeping a clean design of the dial, a simplified mechanism because fewer elements are involved and a thinner watch.

An advantage related to this arrangement is that two pieces of information do not need to have the same time base, and therefore can be jumping or dragging.

According to one embodiment, said at least one first counter is a first display cam or a first display core.

According to one embodiment, said at least one second counter is a second display cam or a second display core.

According to one embodiment, said at least one clutch organ is configured to bear on said at least one first counter and/or said at least one second counter so as to displace said at least one display mobile.

According to one embodiment, said at least one control organ is a control wheel.

According to one embodiment, said at least one display mobile is a display wheel.

According to one embodiment, said at least one clutch organ is connected by at least one mechanical connection to said at least one display mobile and to said at least one control organ.

Thanks to this arrangement, the displacement between said at least one first position and said at least one second position of said at least one clutch organ is dependent on said at least one control organ and said at least one display mobile.

According to one embodiment, said at least one mechanical connection comprises a pivot connection, in particular said at least one display mobile and/or said at least one control organ is mounted or are mounted on said at least one clutch organ, and preferably said at least one clutch organ is pivotally mounted on said at least one display mobile and/or on said at least one control organ.

According to one embodiment, said pivot connection is a blom stud or a pin.

Thanks to one of these arrangements, the displacement between said at least one first position and said at least one second position of said at least one clutch organ is achieved by pivoting.

According to one embodiment, said at least one display mobile and/or said at least one control organ comprises a groove configured to allow the sliding of said pivot connection of said at least one clutch organ, and preferably of said pin, and/or said at least one clutch organ comprises a groove configured to allow the sliding of said pivot connection, and preferably of said pin, of said at least one display mobile and/or of said at least one control organ.

Thanks to this arrangement, the displacement between said at least one first position and said at least one second position is achieved by pivoting and sliding said at least one clutch organ.

According to one embodiment, said at least one clutch organ comprises at least one actuating arm; said at least one control organ is configured to displace said at least one clutch organ by means of said at least one actuating arm.

Thanks to this arrangement, said at least one actuating arm allows the displacement of said at least one clutch organ when said at least one actuating arm is actuated by said at least one control organ.

According to one embodiment, the displacement of said at least one control organ causes the displacement of said at least one clutch organ by means of said at least one actuating arm.

Thanks to this arrangement, said at least one control organ controls the displacement of said at least one clutch organ by said at least one control organ.

According to one embodiment, said at least one actuating arm comprises said mechanical connection and/or said groove.

Thanks to this arrangement, said at least one control organ controls the displacement of said at least one actuating arm and consequently the displacement of said at least one clutch organ.

According to one embodiment, said at least one display mobile is configured to displace with a first speed, said at least one control organ is configured to displace with a second speed and said at least one clutch organ is configured to displace between said at least one first position and said at least one second position when said first speed of said at least one display mobile is different from said second speed of said at least one control organ.

According to one embodiment, when said first speed of said at least one display mobile is greater than said second speed of said at least one control organ, said at least one clutch organ displaces from said at least one first position to said at least one second position.

According to one embodiment, when said first speed of said at least one display mobile is less than said second speed of said at least one control organ, said at least one clutch organ displaces from said at least one second position to said at least one first position.

Thanks to either of these preceding arrangements, when the speeds of said at least one display mobile and of said at least one control organ are different, said at least one clutch organ is displaced between said at least one first position and said at least one second position.

According to one embodiment, said at least one first counter including at least one first abutment configured to limit the mobility of said at least one clutch organ when said at least one clutch organ drives said at least one display mobile to said at least one first position so as to display said first piece of information and preferably to stop said at least one clutch organ so that said at least one display mobile displays said first piece of information.

According to one embodiment, said at least one second counter including at least one second abutment configured to limit the mobility of said at least one clutch organ when said at least one clutch organ drives said at least one display mobile to said at least one second position so as to display said second piece of information and preferably to stop said at least one clutch organ so that said at least one display mobile displays said second piece of information.

Thanks to this arrangement, said at least one display mobile can indicate said first piece of information when said at least one clutch organ is in abutment against said at least one first abutment of said at least one first counter or said second piece of information when said at least one clutch organ is in abutment against said at least one second abutment of said at least one second counter.

According to one embodiment, said at least one first counter including at least one first bearing surface configured to contact said at least one clutch organ with said at least one first abutment when said at least one clutch organ is movable from said second position to said first position.

According to one embodiment, said at least one second counter including at least one second bearing surface configured to contact said at least one clutch organ with said at least one second abutment when said at least one clutch organ is movable from said first position to said second position.

According to one embodiment, said at least one clutch organ displaces said at least one display mobile to said at least one first position when said at least one clutch organ displaces bearing on said at least one first bearing surface.

According to one embodiment, said at least one clutch organ displaces said at least one display mobile to said at least one second position when said at least one clutch organ displaces bearing on said at least one second bearing surface.

According to one embodiment, said at least one first bearing surface has at least one first dimension configured to allow said at least one clutch organ at any point of contact to be brought to said at least one first abutment.

According to one embodiment, said at least one first abutment is a notch and/or a cavity on and/or in said at least one first bearing surface.

According to one embodiment, said at least one second bearing surface has at least one second dimension configured to allow said at least one clutch organ at any point of contact to be brought to said at least one second abutment.

According to one embodiment, said at least one second abutment is a notch and/or a cavity on and/or in said at least one second bearing surface.

According to one embodiment, said at least one second bearing surface is outside or inside said at least one second counter.

According to one embodiment, said at least one first bearing surface is inside or outside said at least one first counter.

According to one embodiment, said at least one second bearing surface has a core shape inside said at least one second counter.

According to one embodiment, said at least one first counter has a first cam shape.

According to one embodiment, said at least one second counter has a second cam shape.

Thanks to either of these preceding arrangements, said at least one clutch organ can drive said at least one first counter or said at least one second counter when it is in abutment against said at least one second abutment and/or said at least one second abutment respectively.

According to one embodiment, said at least one first counter and/or said at least one second counter comprises or comprise an inner toothing and/or outer toothing configured to be meshed and/or to mesh and preferably so that said at least one first counter and/or said at least one second counter operates or operate in a gear.

Thanks to this arrangement, said at least one first counter and/or said at least one second counter may be meshed or may mesh so as to indicate a first piece of information and/or a second piece of information respectively.

According to one embodiment, said at least one clutch organ comprises a pinion, a spindle and/or a pad in order to be bearing or to bear and preferably to mesh, roll and/or slide on said at least one first bearing surface or said at least one second bearing surface.

Thanks to this arrangement, said at least one clutch organ can drive said at least one display mobile by bearing and preferably by meshing, rolling and/or sliding on said at least one first counter or on said at least one second counter.

According to one embodiment, said at least one clutch organ comprises a bearing arm configured to be bearing or to bear on said at least one first bearing surface and/or on said at least one second bearing surface.

Thanks to this arrangement, said at least one clutch organ can drive said at least one display mobile by bearing and preferably by meshing, rolling and/or sliding on said at least one first counter or on said at least one second counter.

According to one embodiment, said at least one bearing arm is flexible and/or elastically deformable.

Thanks to this arrangement, said at least one bearing arm can exert and/or transmit a force on said at least one first bearing surface and/or on said at least one second bearing surface, and to allow to take up the toothing and pivoting clearances of the elements in order to prevent the display hand from twisting.

According to one embodiment, said bearing arm comprises said spindle and/or said pad.

According to one embodiment, said bearing arm comprises a dimension configured to allow said pinion, said spindle and/or said pad to traverse said at least one first bearing surface and/or said at least one second bearing surface to said at least one first abutment and/or said at least one second abutment.

Thanks to either of these preceding arrangements, said at least one clutch organ can reach said at least one first abutment and/or said at least one second abutment at any point of contact with said at least one first counter and/or said at least one second counter.

According to one embodiment, said dimension of said bearing arm, said groove of said at least one control organ and/or of said at least one clutch organ, said at least one first dimension and/or said at least one second dimension are related by their shape and preferably by a mathematical function so that at any point of contact said at least one clutch organ is brought to said at least one first abutment and/or to said at least one second abutment.

Thanks to this arrangement, said at least one clutch organ can reach said at least one first abutment and/or said at least one second abutment at any point of contact with said at least one first counter and/or said at least one second counter.

According to one embodiment, said at least one first counter and said at least one second counter are coplanar.

Thanks to this arrangement, space is saved.

According to one embodiment, said at least one first counter, said at least one second counter, said at least one control organ and/or said at least one display mobile, are movably mounted on at least one axis.

According to one embodiment, said at least one first counter, said at least one second counter, said at least one control organ and/or said at least one display mobile, are movably mounted around said at least one axis.

Thanks to either of these preceding arrangements, said display mechanism is adapted for a rotary and/or repetitive displacement.

According to one embodiment, said display mechanism comprises a differential configured to be driven by and/or to drive said at least one display mobile and/or said at least one control organ so as to distribute the kinetic force between said at least one display mobile and said at least one control organ and preferably between said first speed of said at least one display mobile and said second speed of said at least one control organ.

Thanks to this arrangement, the differential allows not to displace said at least one display mobile on the one hand when said at least one clutch organ displaces between said at least one first position and said at least one second position thanks to the force exerted by said at least one control organ on said at least one clutch organ, and on the other hand the energy of said force exerted by said at least one control organ on said at least one clutch organ is increased so as to allow said at least one clutch organ to reach said at least one first abutment or said at least one second abutment.

The embodiments and the variants mentioned above can be taken separately or in any technically possible combination.

The present invention will be well understood and its advantages will also become apparent in light of the description which follows, given only by way of non-limiting example and made with reference to the appended figures, wherein identical reference signs correspond to structurally and/or functionally identical or similar elements.

BRIEF DESCRIPTION OF THE FIGURES

The invention will be described in more detail below using the appended drawings, given by way of non-limiting examples, wherein.

DETAILED DESCRIPTION OF THE INVENTION

Figure 4:
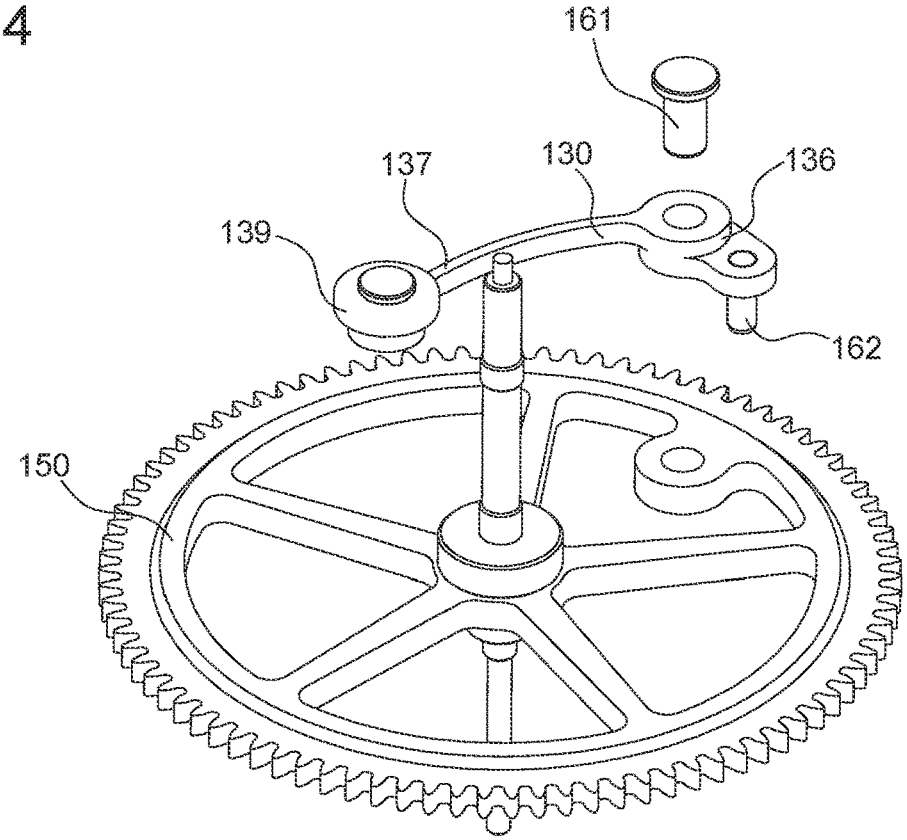
FIG. 4 shows at least one clutch organ 130 and at least one display mobile 150 according to one embodiment.
Figure 5:
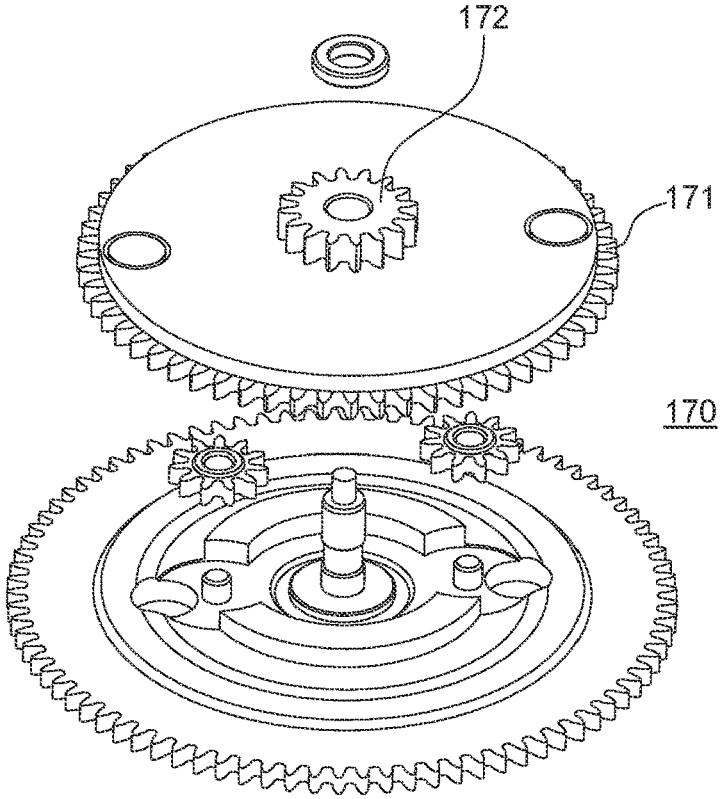
FIG. 5 shows an example of differential 170, according to one embodiment.

The present invention proposes to display and in particular to indicate two pieces of information via a single display mobile 150, illustrated in FIG. 4, so as to be able to arrange several indications while keeping a clean dial design.

Figure 1:
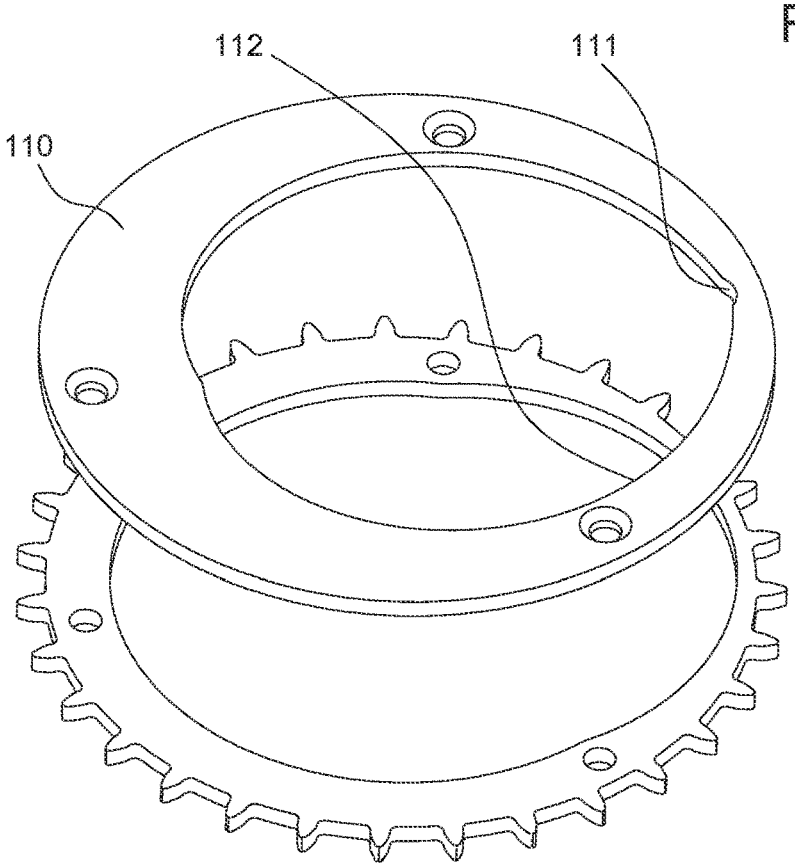
FIGS. 1 & 2 show, according to one embodiment, at least one first counter 110 and at least one second counter 120 respectively.
Figure 2:
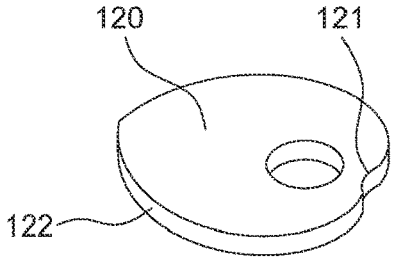

For this purpose, the invention is in the form of a display mechanism 100 comprising at least one first counter 110, shown in FIG. 1, configured to be movable and to indicate a first piece of information and at least one second counter 120, shown in FIG. 2, also configured to be movable and also to indicate a second piece of information.

Typically, as shown in FIG. 1, said at least one first counter 110 may be in the shape of a first display cam 110 or a first display core 110, just like said at least one second counter 120, which can also be a second display cam 120 or a second display core 120, see for example FIG. 2.

Said display mechanism 100 of the present invention also comprises at least one display mobile 150, typically a display wheel 150, configured to display said first piece of information of said at least one first counter 110 and/or to display said second piece of information of said at least one second counter 120 and allowing an indicator to indicate either said first piece of information or said second piece of information.

This change of indication is allowed by at least one clutch organ 130 which allows the displacement of said at least one display mobile 150 between at least one first position 131 so as to display said first piece of information and at least one second position 132 so as to display said second piece of information.

Said at least one clutch organ 130 is controlled by at least one control organ 140, which may be in the shape of a control wheel 140, to be displaced between said at least one first position 131 and said at least one second position 132. Indeed, said at least one clutch organ 130 is configured to be able to bear on said at least one first counter 110 and/or said at least one second counter 120 so as to displace said at least one display mobile 150 until either said first piece of information or said second piece of information is displayed.

Indeed, according to the embodiment illustrated in FIG. 1, said at least one first counter 110 may include at least one first bearing surface 112 configured to allow the bearing of said at least one clutch organ 130, or more particularly to allow the mobility of said at least one clutch organ 130. Said at least one clutch organ 130 can thus displace said at least one display mobile 150 to said at least one first position 131 when said at least one clutch organ 130 displaces bearing on said at least one first bearing surface 112.

This mobility of said at least one clutch organ 130 may be limited by the presence of at least one first abutment 111, which may be in the shape of a notch and/or a cavity on and/or in said at least one first bearing surface 112, present on said at least one first counter 110 so that when said at least one clutch organ 130 drives said at least one display mobile 150 to said at least one first position 131 to display said first piece of information, said at least one first abutment 111 stops said at least one clutch organ 130 so that said at least one display mobile 150 displays said first piece of information.

The configuration of said at least one second counter 120 is roughly similar to that of said at least one first counter 110, since said at least one second counter 120 also includes at least one second abutment 121, which according to the embodiments, can be a notch and/or a cavity on and/or in said at least one second bearing surface 122, and at least one second bearing surface 122 configured to contact said at least one clutch organ 130 with said at least one second abutment 121. Just like for said at least one first counter 110, said at least one clutch organ 130 can also displace said at least one display mobile 150 to said at least one second position 132 when said at least one clutch organ 130 displaces bearing on said at least one second bearing surface 122.

According to embodiments, said at least one first bearing surface 112 has more specifically at least one first dimension to allow said at least one clutch organ 130 to be brought to said at least one first abutment 111 at any point of contact with said at least one first bearing surface 112, just like said at least one second bearing surface 122, which may also have at least one second dimension configured to allow said at least one clutch organ 130 at any point of contact to be brought to said at least one second abutment 121.

These bearing surfaces, that is to say said at least one first bearing surface 112 and said at least one second bearing surface 122 may be outside or inside said at least one first counter 110 and/or said at least one second counter 120 respectively. However, it should be noted that despite the fact that said at least one first bearing surface 112 and said at least one second bearing surface 122 have a core shape, whether it is outside or inside said at least one first counter 110 and/or said at least one second counter 120, said at least one first bearing surface 112 and at least one second bearing surface 122 may have other shapes and in an independent manner.

In addition, still in relation with said at least one first counter 110 and/or said at least one second counter 120, it can comprise or they can comprise, according to the embodiments, an inner toothing and/or outer toothing configured to be meshed and/or to mesh and preferably so that said at least one first counter 110 and/or said at least one second counter 120 operates or operate in a gear so as to indicate a first piece of information and/or a second piece of information respectively.

Thus, the mobility of said at least one clutch organ 130 is limited by said at least one second abutment 121 so that said at least one clutch organ 130 can drive said at least one display mobile 150 to said at least one second position 132 and therefore display said second piece of information and preferably to stop said at least one clutch organ 130 so that said at least one display mobile 150 displays said second piece of information.

Therefore, said at least one display mobile 150 can indicate said first piece of information when said at least one clutch organ 130 is in abutment against said at least one first abutment 111 of said at least one first counter 110 or said second piece of information when said at least one clutch organ 130 is in abutment against said at least one second abutment 121 of said at least one second counter 120.

More specifically, the displacement of said at least one clutch organ 130 between said at least one first position 131 and said at least one second position 132 is carried out when said at least one display mobile 150 displaces with a first speed and said at least one control organ 140 displaces with a second speed different from said first speed of said at least one display mobile 150. Indeed, when said first speed of said at least one display mobile 150 is greater than said second speed of said at least one control organ 140, said at least one clutch organ 130 displaces from said at least one first position 131 to said at least one second position 132, for example and when said first speed of said at least one display mobile 150 is less than said second speed of said at least one control organ 140, said at least one clutch organ 130 displaces from said at least one second position 132 to said at least one first position 131.

Indeed, since when the speeds of said at least one display mobile 150 and of said at least one control organ 140 are different, the mechanical connection 160 is biased by means of said blom stud 161 and said pin 162, which allows said at least one clutch organ 130 to displace or to be displaced between said at least one first position 131 and said at least one second position 132.

Moreover, to this end, said display mechanism 100 comprises a differential 170 configured to be driven by and/or to drive said at least one display mobile 150 and/or said at least one control organ 140 so as to distribute the kinetic force between said at least one display mobile 150 and said at least one control organ 140 and preferably between said first speed of said at least one display mobile 150 and said second speed of said at least one control organ 140 so that said at least one display mobile 150 is not displaced, on the one hand when said at least one clutch organ 130 displaces between said at least one first position 131 and said at least one second position 132 thanks to the force exerted by said at least one control organ 140 on said at least one clutch organ 130, and on the other hand the energy of said force exerted by said at least one control organ 140 on said at least one clutch organ 130 is increased so as to allow said at least one clutch organ 130 to reach said at least one first abutment 111 or said at least one second abutment 121.

Figure 6:
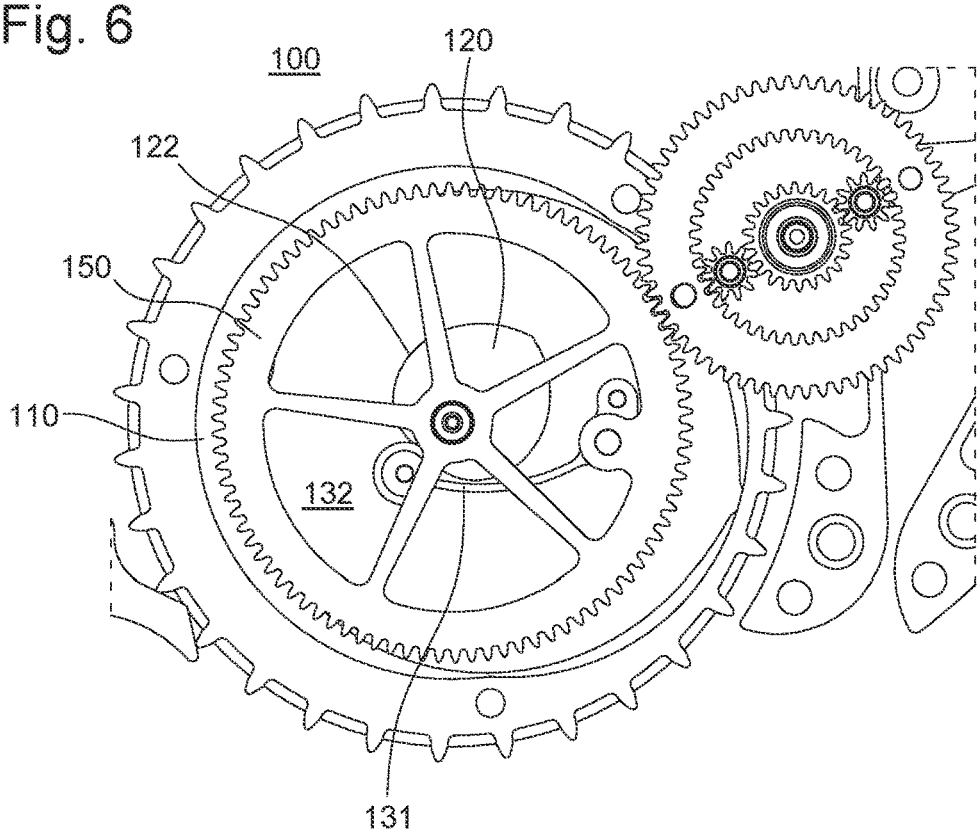
FIGS. 6 & 7 show an example of a display mechanism 100 seen from above and seen from below; and, FIG. 8 illustrates an embodiment of said implemented display mechanism.
Figure 7:
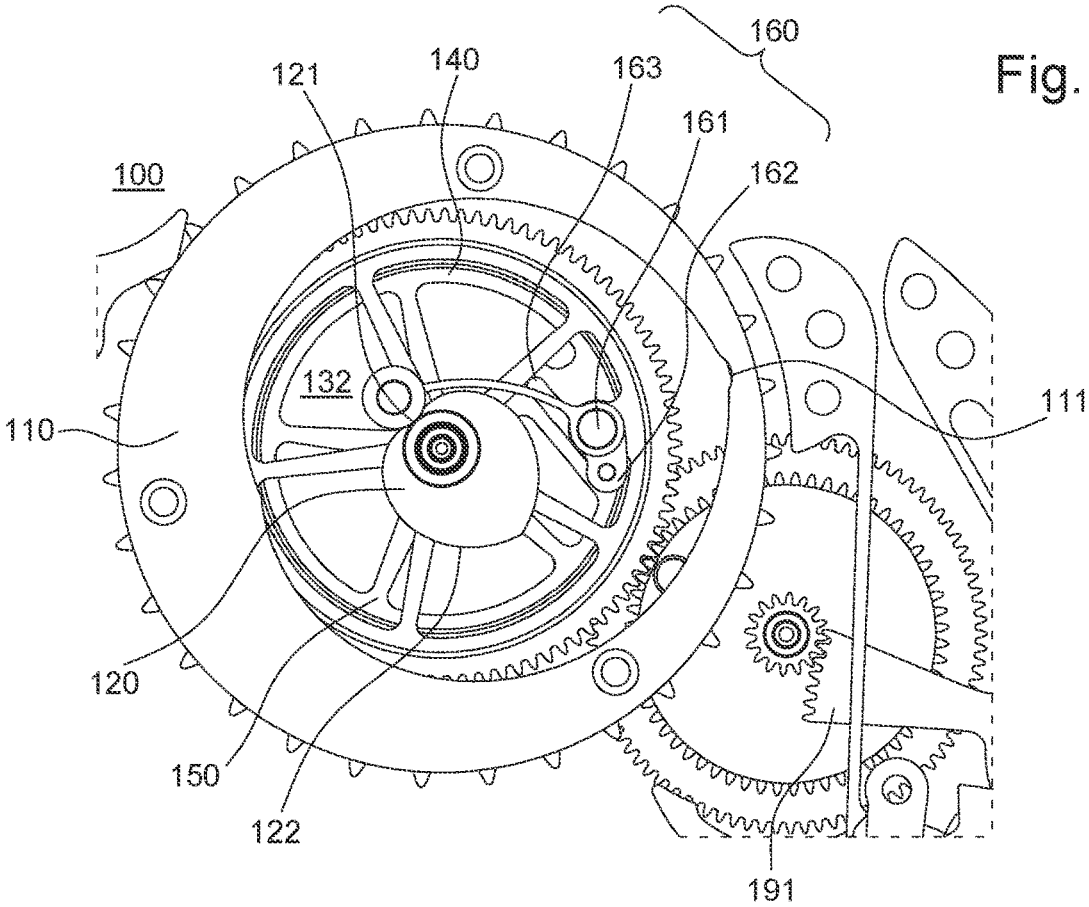
Figure 8:
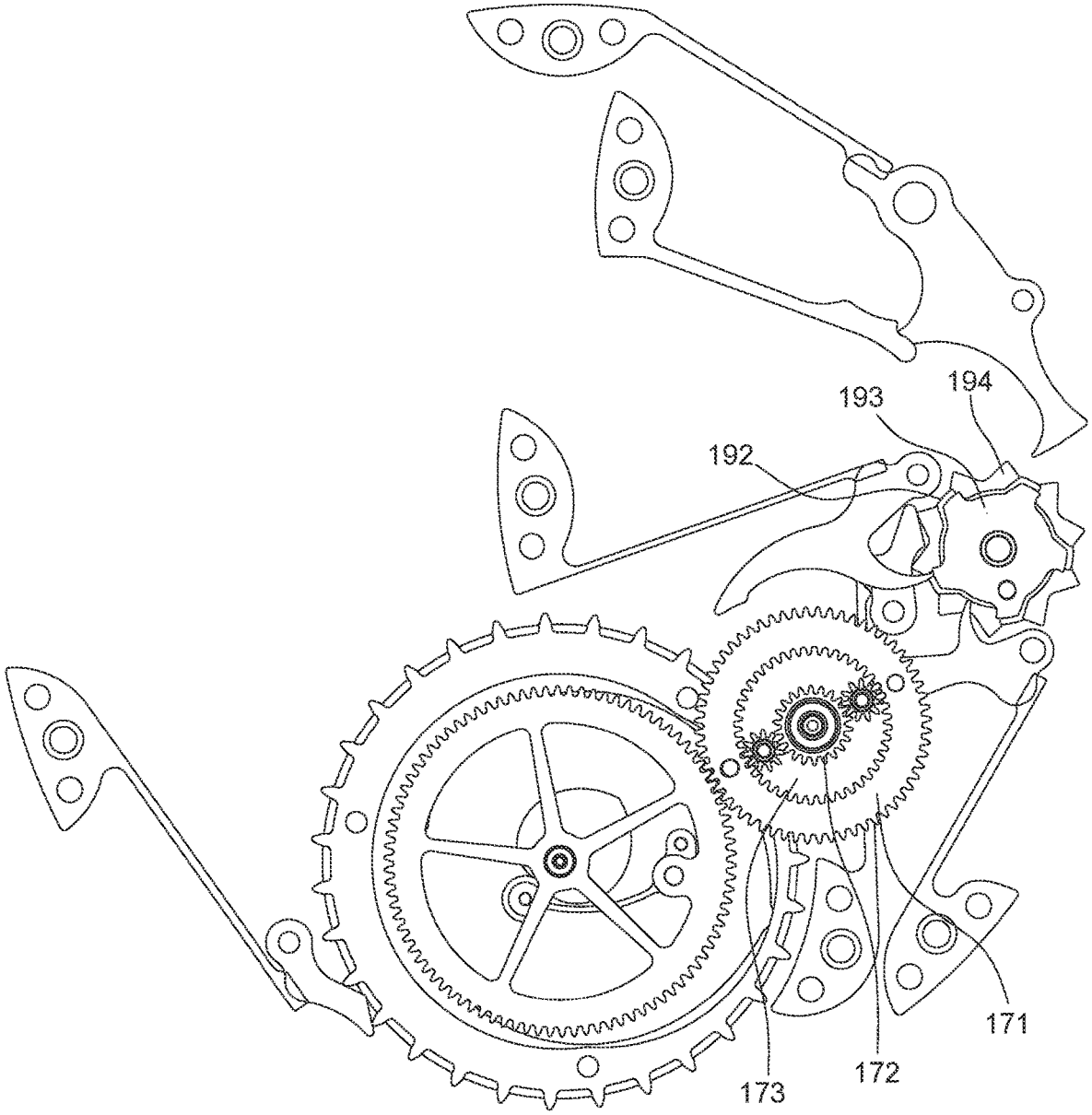

As shown in FIGS. 6 and 7, said at least one clutch organ 130 is connected by at least one mechanical connection 160 to said at least one display mobile 150 and to said at least one control organ 140 so that the displacement between said at least one first position 131 and said at least one second position 132 of said at least one clutch organ 130 is dependent on said at least one control organ 140 and on said at least one display mobile 150.

Said at least one mechanical connection 160 may be a pivot connection 161, and more specifically a blom stud 161 or a pin 162, in particular said at least one display mobile 150 and/or said at least one control organ 140 is mounted or are mounted on said at least one clutch organ 130. It is also possible to consider that said at least one clutch organ 130 is pivotally mounted on said at least one display mobile 150 and/or on said at least one control organ 140, so that the displacement between said at least one first position 131 and said at least one second position 132 of said at least one clutch organ 130 is carried out by pivoting.

Furthermore, this pivoting can facilitate and/or save space if said at least one first counter 110 and said at least one second counter 120 can be coplanar. In the embodiment illustrated in FIGS. 6 and 7, said at least one first counter 110, said at least one second counter 120, said at least one control organ 140 and/or said at least one display mobile 150, are movably mounted on at least one axis or even around said at least one axis so that said display mechanism 100 is adapted for rotary and/or repetitive displacement.

Still with regard to this pivoting, said at least one mechanical connection 160 is a pin 162 allowing said at least one display mobile 150 and said at least one clutch organ 130 to pivot relative to each other and in particular, said at least one clutch organ 130 comprises a pin 162 and said at least one display mobile 150 a housing for accommodating said pin 162, as shown in the embodiment of FIG. 4, for example.

Furthermore, according to one embodiment, said at least one display mobile 150 and/or said at least one control organ 140 may comprise a groove 163 configured to allow the sliding of said pivot connection of said at least one clutch organ 130 and/or said at least one clutch organ 130 comprises a groove 163 configured to allow the sliding of said pivot connection of said at least one display mobile 150 and/or of said at least one control organ 140.

Figure 3:
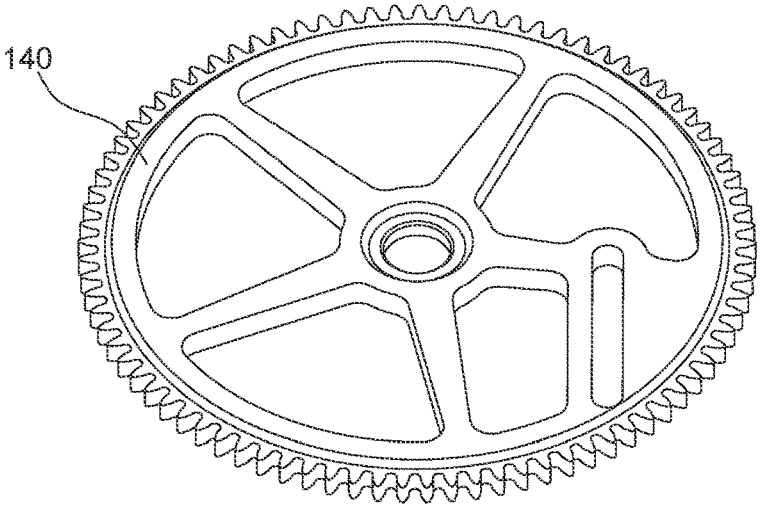
FIG. 3 illustrates at least one control organ 140 according to one embodiment.

In the embodiment of FIG. 3, only said at least one control organ 140 comprises a groove 163 and said at least one mechanical connection 160 is made by said blom stud 161 which can slide in said groove 163 so as to perform the displacement between said at least one first position 131 and said at least one second position 132 by pivoting and sliding said at least one clutch organ 130.

It should also be indicated that said at least one actuating arm 136 may comprise said mechanical connection 160 and/or said groove 163, according to some embodiments, so that said at least one control organ 140 controls the displacement of said at least one actuating arm 136 and consequently the displacement of said at least one clutch organ 130.

Said at least one clutch organ 130, described just before, comprises on the one hand at least one actuating arm 136 and on the other hand at least one bearing arm 137. According to the embodiments, said at least one actuating arm 136 and said at least one bearing arm 137 can be located on either side of said blom stud 161.

Said at least one actuating arm 136 is used to displace said at least one clutch organ 130 via said pin 162 which may be located at the end of said at least one clutch organ 130 and consequently, at the end of said at least one actuating arm 136, so that when said at least one actuating arm 136 is actuated by said at least one control organ 140, said at least one actuating arm 136 displaces said at least one clutch organ 130 around the pivot connection 160.

As can be understood, the displacement of said at least one control organ 140 causes the displacement of said at least one clutch organ 130 by means of said at least one actuating arm 136.

As mentioned above, said at least one bearing arm 137 is located on the other side of said at least one clutch organ 130 relative to said at least one actuating arm 136. A pinion, a spindle 139 and/or a pad, is located at another end of said at least one clutch organ 130, more specifically at the end of said at least one bearing arm 137, according to the embodiments, in order to be bearing or to bear and preferably to mesh, roll and/or slide on said at least one first bearing surface 112 or said at least one second bearing surface 122, which allows said at least one clutch organ 130 to be movable when it is in contact with said at least one first counter 110 or said at least one second counter 120 and therefore drive said at least one display mobile 150 by bearing and preferably by meshing, rolling and/or sliding on said at least one first counter 110 or on said at least one second counter 120.

Moreover, one of the features of said at least one bearing arm 137 is that it is flexible and/or elastically deformable, which allows the latter to exert and/or transmit a force on said at least one first bearing surface 112 and/or on said at least one second bearing surface 122, and to allow to take up the toothing and pivoting clearances of the elements in order to prevent the display hand from twisting.

In addition, said bearing arm 137 may comprise a dimension configured to allow said pinion, said spindle 139 and/or said pad to traverse said at least one first bearing surface 112 and/or said at least one second bearing surface 122 to said at least one first abutment 111 and/or said at least one second abutment 121, so as to be able to reach said at least one first abutment 111 and/or said at least one second abutment 121 at any point of contact with said at least one first counter 110 and/or said at least one second counter 120. Moreover, according to one embodiment, said dimension of said bearing arm 137, said groove 163 of said at least one control organ 140 and/or of said at least one clutch organ 130, said at least one first dimension and/or said at least one second dimension may be related by their shape and preferably by a mathematical function so that at any point of contact said at least one clutch organ 130 is brought to said at least one first abutment 111 and/or to said at least one second abutment 121.

In the embodiment of FIGS. 6 and 7, at least one first counter 110, which may be in the shape of a first display core 110 or a first display cam 110 as shown in FIGS. 6 & 7, or is related to a first piece of information, for example the date, and at least one second counter 120, a second display cam 120 or a second display core 120 as illustrated in FIGS. 6 & 7, is related to a second piece of information, for example the second. Said at least one first counter 110 and at least one second counter 120 are coaxial and at the same height, that is to say coincident in the same plane.

Said display mechanism 100 also comprises at least one display mobile 150 including at least one clutch organ 130 on which a spindle 139 pivots. Said at least one clutch organ 130 is constrained on one of said at least one first counter 110 and at least one second counter 120 by means of at least one control organ 140 which can act on a pin 162. In one of the display positions, said spindle 139 is in a notch of said at least one second counter 120. Being driven by the movement (not shown), said at least one second counter 120 thus drives said at least one display mobile 150. The movement therefore displays said first piece of information of said at least one first counter 110.

In other words, in the embodiment shown in FIGS. 6 & 7, said at least one control organ 140 comprises a groove 163, or more commonly called a "loop", which so as not to be offset relative to said at least one clutch organ 130, said at least one display mobile 150 drives said at least one control organ 140 at the same speed by means of a first input 171 of a differential 170. The second input 172 of said differential 170 is linked to a rack 191 which feels a display change cam 192. The speed of rotation of said at least one control organ 140 is the sum of the speeds of said first input 171 and of said second input 172.

Indeed, for example, when the user controls the change of display, a star 194. Said aforementioned cams 192, 193 are driven on said star 194, they also rotate. The first degrees of rotation of said cams 192, 193 allow to release a brake 195 which acts on said first input 171 of said differential 170. While said brake 195 is maintained, a feeler of said rack 191 will switch to a jag of said display change cam 192 thus actuating said second input 172 of said differential 170. The latter, that is to say said second input 172 of said differential 170 being maintained and an output 173 of said differential 170 being free, the rotation of said rack 191 will drive said output 173 of said differential 170 and therefore said at least one clutch organ 130.

By means of said pin 162 and said loop of said at least one clutch organ 130, a bearing arm 137 comprised by said at least one clutch organ 130 will pivot until said spindle 139 is in contact with said at least one first counter 110. Said spindle 139 will then roll to at least one second abutment 121, which may be in the shape of a notch 121, of said at least one first counter 110 thus driving a display wheel. The system then displays said second piece of information of said at least one second counter 120.

The arrangement of said cams 192, 193 allows the components to be moved in the following order:

Switching said first piece of information of said at least one first counter 110 to said second piece of information of said at least one second counter 120: Placing and maintaining said brake 195 then activating said differential 170;

Switching said second piece of information of said at least one second counter 120 to said first piece of information of said at least one first counter 110: maintaining said brake 195 then activating said differential 170 and releasing said brake 195;

In another mode of use, the cam 193 can be removed. In this embodiment, the differential as well as the loop of the clutch organ 130 are arranged so that the action of the input 172 of the differential causes the outputs 170, 171 to rotate in the opposite direction. The natural movement of the elements causes the pin 162 to slide on the loop of the clutch organ 130 in order to change the display. This mode of use allows to eliminate having to act on the sequencing of cams 192, 193.

The displays being driven by the movement and the forces required to switch from one display to another are to be overcome by the user, the torque required by said first piece of information of said at least one first counter 110 is low since only the friction in the geartrain are to be overcome.

By modifying the geometry of the cam, it is possible to deactivate the brake at each end of the display change. In conclusion, the system requires very little torque to be power supplied. The resulting advantage is the possibility of displaying the second on one of the two displays without disturbing the working of the movement, for example.

In addition, according to the embodiments, it is possible to have an additional bearing arm opposite said bearing arm 137, on a different level for example in order to add different information, so as to display 4 different information with the same hand while leaving the possibility to the user to switch from one to the other.

For this purpose, it is necessary to add additional cams at the same level as the additional bearing arm and to modify the loop in said at least one control organ 140 and by adding another one acting on the second arm and finally, increase the number of cams from two to four bearings at said cam 192.

The invention claimed is:

1. A display mechanism comprising at least:

a first counter, said at least one first counter being configured to be movable and to indicate a first piece of information;

a second counter, said at least one second counter being configured to be movable and to indicate a second piece of information;

a display mobile, said at least one display mobile being configured to display said first piece of information of said at least one first counter and/or to display said second piece of information of said at least one second counter;

a clutch organ, said at least one clutch organ being configured to displace said at least one display mobile between at least one first position so as to display said first piece of information and at least one second position so as to display said second piece of information; and a control organ, said at least one control organ being configured to displace said at least one clutch organ between said at least one first position and said at least one second position, wherein the first counter and the second counter are coplanar and with the second counter arranged within the first counter.

2. The display mechanism according to claim 1, wherein said at least one clutch organ is connected by at least one mechanical connection to said at least one display mobile and to said at least one control organ.

3. The display mechanism according to claim 1, wherein said at least one mechanical connection comprises a pivot connection, said at least one display mobile and/or said at least one control organ is mounted or are mounted on said at least one clutch organ, and said at least one clutch organ is pivotally mounted on said at least one display mobile and/or on said at least one control organ.

4. The display mechanism according to claim 1, wherein said at least one display mobile and/or said at least one control organ comprises a groove configured to allow the sliding of said pivot connection of said at least one clutch organ and/or said at least one clutch organ comprises a groove configured to allow the sliding of said pivot connection of said at least one display mobile and/or of said at least one control organ.

5. The display mechanism according to claim 1, wherein said at least one clutch organ comprises at least one actuating arm; said at least one control organ is configured to displace said at least one clutch organ by means of said at least one actuating arm.

6. The display mechanism according to claim 5, wherein said at least one actuating arm comprises at least one of said mechanical connection and a groove.

7. The display mechanism according to claim 1, wherein said at least one display mobile is configured to be displaced at a first speed, said at least one control organ is configured to be displaced at a second speed and said at least one clutch organ is configured to be displaced between said at least one first position and said at least one second position when said first speed of said at least one display mobile is different from said second speed of said at least one control organ.

8. The display mechanism according to claim 1, wherein:

said at least one first counter including at least one first abutment configured to limit the mobility of said at least one clutch organ when said at least one clutch organ drives said at least one display mobile to said at least one first position so as to display said first piece of information and to stop said at least one clutch organ so that said at least one display mobile displays said first piece of information; and/or, said at least one second counter including at least one second abutment configured to limit the mobility of said at least one clutch organ when said at least one clutch organ drives said at least one display mobile to said at least one second position so as to display said second piece of information and to stop said at least one clutch organ so that said at least one display mobile displays said second piece of information.

9. The display mechanism according to claim 1, wherein:

said at least one first counter including at least one first bearing surface configured to contact said at least one clutch organ with said at least one first abutment when said at least one clutch organ is movable from said second position to said first position; and/or, said at least one second counter including at least one second bearing surface configured to contact said at least one clutch organ with said at least one second abutment when said at least one clutch organ is movable from said first position to said second position.

10. The display mechanism according to claim 9, wherein said at least one clutch organ comprises a pinion, a spindle and/or a pad in order to be bearing or to bear and to mesh, roll and/or slide on said at least one first bearing surface or said at least one second bearing surface.

11. The display mechanism according to claim 9, wherein said at least one clutch organ comprises a bearing arm configured to be bearing or to bear on said at least one first bearing surface and/or on said at least one second bearing surface.

12. The display mechanism according to claim 11, wherein said bearing arm comprises said spindle and/or said pad.

13. The display mechanism according to claim 1, wherein said at least one first counter and said at least one second counter are coplanar.

14. The display mechanism according to claim 1, wherein said at least one first counter, said at least one second counter, said at least one control organ and/or said at least one display mobile, are movably mounted on at least one axis.

15. The display mechanism according to claim 1, which comprises a differential configured to be driven by and/or to drive said at least one display mobile and/or said at least one control organ so as to distribute the kinetic force between said at least one display mobile and said at least one control organ and between said first speed of said at least one display mobile and said second speed of said at least one control organ.

16. The display mechanism according to claim 1, wherein the first counter surrounds the second counter at least in a plane in which the first counter and the second counter are coplanar.

* * * * *